US008803754B2

(12) United States Patent
Shirakawa et al.

(10) Patent No.: US 8,803,754 B2
(45) Date of Patent: Aug. 12, 2014

(54) ANTENNA AND WIRELESS DEVICE HAVING SAME

(75) Inventors: Yohei Shirakawa, Hitachi (JP); Kazuhiro Fujimoto, Hitachi (JP); Masamichi Kishi, Hitachinaka (JP); Naoto Teraki, Takahagi (JP); Yoshitake Ageishi, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 447 days.

(21) Appl. No.: 13/137,080

(22) Filed: Jul. 19, 2011

(65) Prior Publication Data

US 2012/0154240 A1 Jun. 21, 2012

(30) Foreign Application Priority Data

Dec. 16, 2010 (JP) ..... 2010-280501

(51) Int. Cl.
*H01Q 11/00* (2006.01)

(52) U.S. Cl.
USPC ..... 343/843; 343/767

(58) Field of Classification Search
USPC ..... 343/843, 767, 700 MS, 702, 897, 866
See application file for complete search history.

(56) References Cited

U.S. PATENT DOCUMENTS 5,805,114 A * 9/1998 Podger ..... 343/742
6,639,559 B2 * 10/2003 Okabe et al. ..... 343/700 MS
6,847,329 B2 1/2005 Ikegaya et al.
2004/0008146 A1 1/2004 Ikegaya et al.
2005/0153756 A1 7/2005 Sato et al.
2006/0061513 A1 * 3/2006 Sato ..... 343/767
2012/0026009 A1 * 2/2012 Zhao et al. ..... 340/870.28

FOREIGN PATENT DOCUMENTS

JP 2004-48119 A 2/2004
JP 3690375 B2 6/2005
JP 3805772 B2 8/2006
JP 2007-20133 A 1/2007
JP 2009-124355 A 6/2009

OTHER PUBLICATIONS

Notification of Reason(s) for Refusal dated Feb. 28, 2014, with English translation.

* cited by examiner

*Primary Examiner* — Thien M Le
(74) *Attorney, Agent, or Firm* — McGinn IP Law Group, PLLC

(57) ABSTRACT

An antenna includes an antenna element to transmit or receive electromagnetic signals, and a ground conductor to be grounded. The antenna element includes two conductors arranged substantially parallel to each other, a power feed portion provided between one conductor of the two conductors and the ground conductor, and connected to a feed system, a shorting portion for electrically connecting an other conductor of the two conductors and the ground conductor, and a conductor connecting portion for electrically connecting the two conductors together. The distance between the two conductors is not more than 1/100 a wavelength equivalent to a minimum frequency of operating frequencies of the antenna.

20 Claims, 14 Drawing Sheets

ANTENNA AND WIRELESS DEVICE HAVING SAME

The present application is based on Japanese patent application No. 2010-280501 filed on Dec. 16, 2010, the entire contents of which are incorporated herein by reference.

BACKGROUND OF THE INVENTION

1. Field of the Invention

This invention relates to an antenna, which is mounted on a notebook personal computer, UMPC (ultra mobile personal computer), netbook, mobile phone, PND (personal navigation device), sensor network terminal, or the like, and which is for transmitting or receiving electromagnetic signals, and a wireless device having the antenna.

2. Description of the Related Art

There has been suggested a planar multi-antenna (e.g. refer to JP Patent No. 3690375), which is employed for wireless communications, by being adaptable for wireless systems, such as WWANs (Wireless Wide Area Networks), WLANs (Wireless Local Area Networks), RFID (Radio Frequency Identification), WiMAX (Worldwide Interoperability for Microwave Access), Bluetooth, LTE (Long Term Evolution) and the like, and by being built into wireless communications terminals (wireless devices), such as notebook personal computers, UMPCs, netbooks, mobile phones, PNDs, sensor network terminals, and the like, which are compatible with those wireless systems.

The planar multi-antenna is small in size so as to be suitable for being built into the wireless communications terminals, and is operable in a plurality of frequency bands used for communications.

FIG. 23 shows one example of the conventional planar multi-antenna.

As shown in FIG. 23, the planar multi-antenna 231 is equipped with an antenna element 232 to transmit or receive electromagnetic signals, a ground conductor 233 to be grounded, and a power feed portion 234 for being connected to a feed system. The antenna element 232 is structured to have a plurality of rectangular conductors (which are rectangular in plan view) combined therein.

Refer to JP Pat. No. 3690375, for example.

SUMMARY OF THE INVENTION

In recent years, the previously mentioned wireless communications terminals have been required to be small in size and free from irregularities in outer shape so as to be easy to carry. Also, because to maintain good antenna radiation properties, the antenna mounted on the wireless communications terminals is often placed in a substantially free space, i.e. near a chassis wall in the wireless communications terminals, the outer shape of the wireless communications terminals is significantly affected by the size of the antenna.

In the conventional planar multi-antenna 231, however, because the antenna element 232 comprises the plurality of the conductors, and the plurality of the conductors are structured to be placed in turn on the ground conductor 233, the height of the antenna, i.e. the distance from the upper end of the ground conductor 233 to the uppermost end of the antenna element 232 farthest from the ground conductor 233 is relatively large.

When the height of the antenna is large, there arises the problem that the outer shape of the wireless communications terminals is significantly irregular, and therefore difficult to carry. Also, when the outer shape of the wireless communications terminals is smoothed, there arises the problem that the size of the wireless communications terminals is large.

On the other hand, when the antenna element 232 is near to the ground conductor 233 so that the height of the antenna is small, there arises another problem that the operating frequency bands of the antenna decrease, and are incompatible with desired frequency bands.

Accordingly, it is an object of the present invention to provide an antenna, which overcomes the above problems, and which is low in height, small in size, and compatible with frequency bands equivalent to conventional antenna frequency bands, and a wireless device having the antenna.

(1) According to one embodiment of the invention, an antenna comprises:

an antenna element to transmit or receive electromagnetic signals; and a ground conductor to be grounded, wherein the antenna element comprises two conductors arranged substantially parallel to each other, a power feed portion provided between one conductor of the two conductors and the ground conductor, and connected to a feed system, a shorting portion for electrically connecting an other conductor of the two conductors and the ground conductor, and a conductor connecting portion for electrically connecting the two conductors together, and wherein the distance between the two conductors is not more than 1/100 a wavelength equivalent to a minimum frequency of operating frequencies of the antenna.

In the above embodiment (1) of the invention, the following modifications and changes can be made.

(i) The one conductor comprises a conductor pattern formed on one surface of a printed board, the other conductor comprises a conductor pattern formed on an other surface of the printed board, and the conductor connecting portion comprises a conductor formed in an inner portion of a through hole formed in the printed board.

(ii) Each of the two conductors comprises a conductor plate, and the conductor connecting portion comprises a linear conductor for electrically connecting the conductor plates together.

(iii) The antenna further comprises a second conductor for serving as a second antenna element which is connected in parallel to the power feed portion.

(iv) The antenna further comprises a plurality of the antenna elements, which share the power feed portion, and which differ in dimensions or shape of the two conductors.

(v) The antenna further comprises a coaxial cable for feeding the power feed portion.

(2) According to another embodiment of the invention, a wireless device wireless device for transmitting information using electromagnetic signals comprises:

an antenna comprising an antenna element to transmit or receive electromagnetic signals; and a ground conductor to be grounded, wherein the antenna element comprises two conductors arranged substantially parallel to each other, a power feed portion provided between one conductor of the two conductors and the ground conductor, and connected to a feed system, a shorting portion for electrically connecting an other conductor of the two conductors and the ground conductor, and a conductor connecting portion for electrically connecting the two conductors together, and wherein the distance between the two conductors is not more than 1/100 a wavelength equivalent to a minimum frequency of operating frequencies of the antenna.

In the above embodiment (2) of the invention, the following modifications and changes can be made.

(vi) The one conductor comprises a conductor pattern formed on one surface of a printed board, the other conductor comprises a conductor pattern formed on an other surface of the printed board, and the conductor connecting portion comprises a conductor formed in an inner portion of a through hole formed in the printed board.

(vii) Each of the two conductors comprises a conductor plate, and the conductor connecting portion comprises a linear conductor for electrically connecting the conductor plates together.

(viii) The wireless device further comprises a second conductor for serving as a second antenna element which is connected in parallel to the power feed portion.

(ix) The wireless device further comprises a plurality of the antenna elements, which share the power feed portion, and which differ in dimensions or shape of the two conductors.

(x) The wireless device further comprises a coaxial cable for feeding the power feed portion.

Points of the Invention

According to one embodiment of the invention, an antenna is constructed such that an antenna element thereof serves as both a shorted ended antenna element and an open ended antenna element, to overlap together an operating band around the series resonant frequency that is the smallest frequency (i.e. the first series resonant frequency) and an operating band around the second smallest series resonant frequency (i.e. the second series resonant frequency). Thereby, it is possible to have a broader operating band than the conventional antenna. In other words, when the antenna has the same size as the conventional antenna, the antenna can have a broader operating band than the conventional antenna.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below are described the preferred embodiments according to the invention, in conjunction with the accompanying drawings.

Herein, the term "electrically connecting" used means connecting such that at both ends connected together, the change in the voltage to current ratio (impedance) of an electrical signal being of an intended frequency is substantially zero.

Antenna 1 Structure

Figure 1:
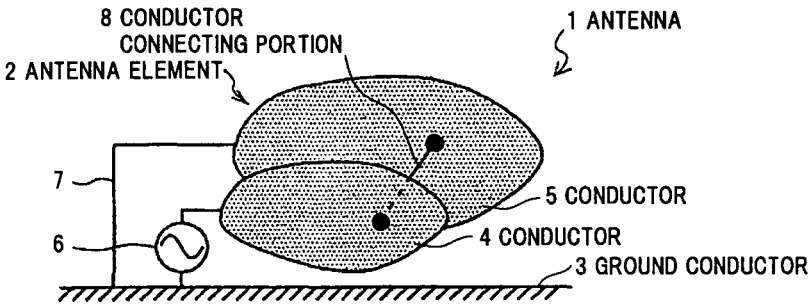
FIG. 1 is a diagram showing a concept of an antenna according to the invention.

FIG. 1 is a diagram showing a concept of an antenna 1 according to the invention.

As shown in FIG. 1, the antenna 1 according to the invention includes an antenna element 2 to transmit or receive electromagnetic signals, and a ground conductor 3 to be grounded. The antenna element 2 includes two conductors 4 and 5 arranged parallel to each other, a power feed portion 6 provided between one conductor 4 of the two conductors 4 and 5 and the ground conductor 3, and connected to a feed system, a shorting portion 7 for electrically connecting the other conductor 5 of the two conductors 4 and 5 and the ground conductor 3, and a conductor connecting portion 8 for electrically connecting the two conductors 4 and 5 together, wherein the distance between the two conductors 4 and 5 is not more than 1/100 a wavelength equivalent to a minimum frequency of operating frequencies of the antenna 1.

Minimum Frequency of Antenna Operating Frequencies

Here, the minimum frequency of the antenna operating frequencies refers to the minimum frequency of electromagnetic signals which the antenna element 2 can transmit or receive, for example a smallest frequency contained in a band in which the return loss is smaller than −6 dB.

A conventional antenna, such as a so called inverted L antenna (or an open ended antenna), is constructed from a conductor and ground, and fed between one point of that conductor and the ground. In the frequency characteristic of the input immittance looked at from the power feed portion of the conventional antenna, when the series resonant frequency that is the smallest frequency is fo, no other series resonant frequency exists in the frequency band smaller than 2 fo. Also, although a matching circuit may be necessary, such a conventional antenna is relatively well matched to a feed system around the series resonant frequency fo, and operates in this frequency band to serve as the antenna. Incidentally, the series resonant frequency refers to a frequency at which the input conductance that is the real component of the input admittance is a maximum value.

In contrast, in the frequency characteristic of the input immittance looked at from the power feed portion 6 of the antenna 1 according to the present invention, when the series resonant frequency that is the smallest frequency is fo', the antenna 1 has another series resonant frequency fo" in the frequency band smaller than 2 fo'. As with the conventional antenna, the antenna 1 is relatively well matched to the feed system around the series resonant frequencies fo' and fo", and operates in these frequency bands to serve as the antenna. Also, the series resonant frequencies fo' and fo" depend on the conductor shapes (i.e. the distance between the conductors 4 and 5, or the shapes of the conductors 4 and 5, the position of the conductor connecting portion 8, etc.), and are therefore adjustable.

In the antenna 1 according to the present invention, the conductor shapes are appropriately adjusted to thereby appropriately select values of the series resonant frequencies fo' and fo", to combine together the bands in which the antenna 1 is operable (referred to as the "operating bands") around the series resonant frequencies fo' and fo" (i.e. to overlap the consecutive operating bands together), and thereby realize a broader operating band than in the conventional antenna. It has been found from experimental results that the difference between the series resonant frequencies fo' and fo" depends on the distance between the conductors 4 and 5, and that, in order to realize the broad band antenna, it is necessary to set the distance between the conductors 4 and 5 at not more than 1/100 a wavelength equivalent to a minimum frequency of operating frequencies of the antenna 1 (its detail is described later).

Generally, there is a positive correlation between the height of an antenna and the frequency band in which that antenna is operable. Thus, broadening the frequency band in which the antenna is operable can ensure the sufficient operating band even when the height of the antenna is made small. This permits size reduction of the antenna.

First Embodiment

Figure 2A:
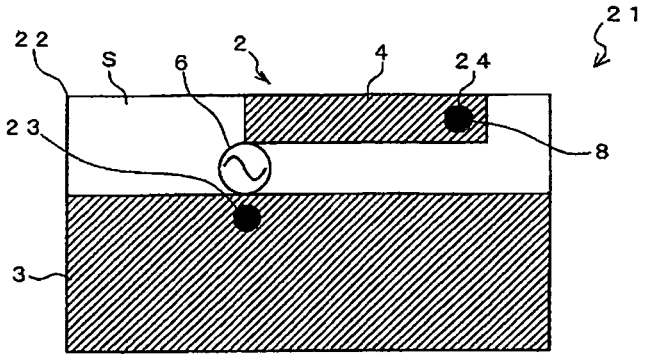
FIG. 2A is a plan view showing an antenna in a first embodiment according to the invention, when viewed from a surface side of a printed board.
Figure 2B:
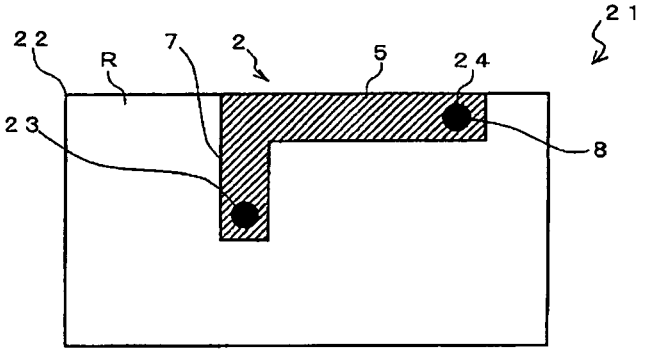
FIG. 2B is a plan view showing the antenna of FIG. 2A, when the reverse side of the printed board is seen through from the surface side thereof.

Referring to FIGS. 2A and 2B, an antenna in a first embodiment according to the invention is shown.

Antenna 21 Structure

As shown in FIGS. 2A and 2B, an antenna 21 in the first embodiment uses a double layer printed board 22, which may be formed with wiring patterns on both its surfaces. In the antenna 21, one surface (or first layer, herein also referred to as "surface") S of the printed board 22 is formed with a conductor pattern, which serves as one conductor 4, and a conductor pattern, which serves as a ground conductor 3, while an other surface (or second layer, herein also referred to as "reverse surface") R of the printed board 22 is formed with a conductor pattern, which serves as an other conductor 5. Incidentally, FIG. 2B is the plan view when the reverse surface of the printed board 22 is seen through from the surface side of the printed board 22.

The printed board 22 may use an FR 4 (Flame Retardant Type 4) glass epoxy printed board, for example.

The conductor pattern, which serves as one conductor 4 (herein simply referred to as "one conductor 4"), is formed in a rectangular shape in the plan view, and a power feed portion 6 is provided between one longitudinal end (left end in FIG. 2A) of the rectangular conductor 4 and the conductor pattern, which serves as the ground conductor 3 (herein simply referred to as the "ground conductor 3"). The power feed portion 6 is fed by use of a coaxial cable not shown. Incidentally, in the first embodiment, the ground conductor 3 is formed in a rectangular shape in the plan view, and the one conductor 4 is spaced from the ground conductor 3, and longitudinally formed along one side of the rectangular ground conductor 3.

The conductor pattern, which serves as the other conductor 5 (herein simply referred to as "the other conductor 5"), is formed in the same rectangular shape as the one conductor 4, and on the opposite side of the printed board 22 to the one conductor 4. Incidentally, although herein the one conductor 4 and the other conductor 5 are the same in shape, the one conductor 4 and the other conductor 5 may be not the same in shape, but differ in dimensions such as length, width, etc., or shape.

One end (left end in FIG. 2B) of the other conductor 5 is formed with a conductor pattern, which serves as a shorting portion 7 (herein simply referred to as "shorting portion 7"). The shorting portion 7 is formed to extend transversely (downward in FIG. 2B) from the one end of the other conductor 5. The other conductor 5 and the shorting portion 7 are formed integrally, to form an entire L shape (L shape rotated clockwise through 90 degrees). A tip of the shorting portion 7 is formed with a through hole 23, and the shorting portion 7 and the ground conductor 3 are electrically connected together via this through hole 23 (a conductor formed in an inner portion of the through hole 23).

Also, the one conductor 4 and the other conductor 5 are electrically connected together via a through hole 24 (a conductor formed in an inner portion of the through hole 24). In other words, the conductor connecting portion 8 in the first embodiment comprises the conductor formed in the inner portion of the through hole 24 formed in the printed board 22.

In the antenna 21, the distance between the two conductors 4 and 5 is adjustable according to the thickness of the printed board 22. That is, the thickness of the printed board 22 is set at not more than 1/100 a wavelength equivalent to a minimum frequency of operating frequencies of the antenna 21.

Relationships between the Frequency Characteristic of the Input Immittance and the Series Resonant Frequencies, and the Antenna 21 Structure The relationships between the frequency characteristic of the input immittance and the series resonant frequencies, and the antenna 21 structure are explained more in detail below. Herein, for simplicity, the input admittance versus frequency characteristic of the antenna 21 according to the present invention, and the input admittance versus frequency characteristic of the conventional antenna are compared.

Figure 3:
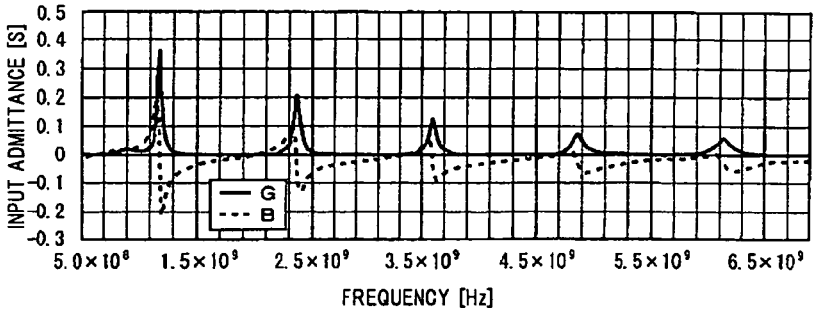
FIG. 3 is a graph showing one example of the input admittance versus frequency characteristic of the antenna shown in FIGS. 2A and 2B.

Referring to FIG. 3, there is shown one example of the input admittance versus frequency characteristic looked at in the antenna direction from the power feed portion 6 in the antenna 21 shown in FIGS. 2A and 2B. The solid line in FIG. 3 denotes the input conductance G that is the real component of the input admittance, while the broken line denotes the susceptance B that is the imaginary component of the input admittance. In this input admittance versus frequency characteristic, the frequency at which the input conductance G of the input admittance versus frequency components is the maximum value is the series resonant frequency.

Figure 4:
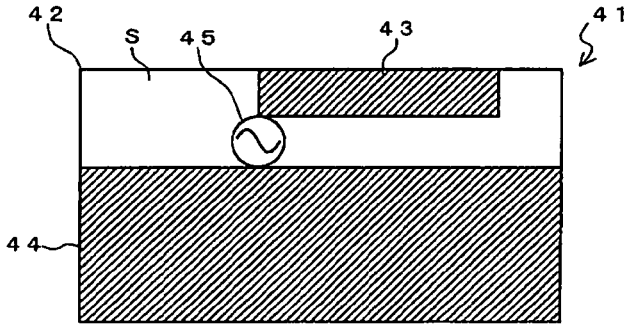
FIG. 4 is a plan view showing an open ended antenna when viewed from a surface side of a printed board, to be compared with the antenna shown in FIGS. 2A and 2B.
Figure 5:
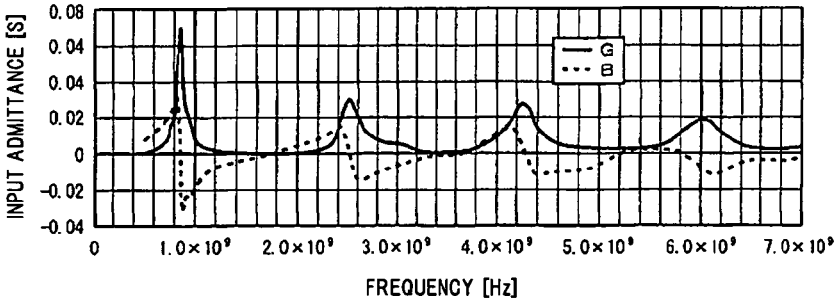
FIG. 5 is a graph showing one example of the input admittance versus frequency characteristic of the open ended antenna shown in FIG. 4.
Figure 6:
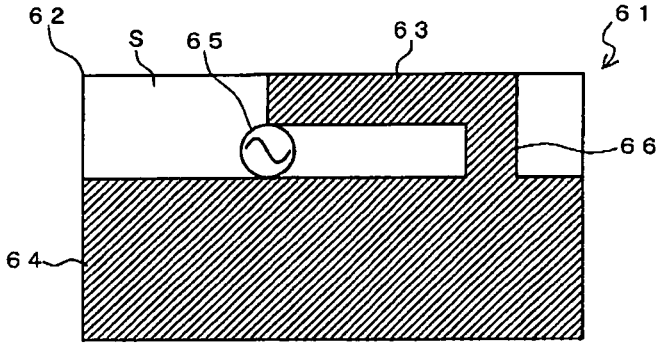
FIG. 6 is a plan view showing a shorted ended antenna when viewed from a surface side of a printed board, to be compared with the antenna shown in FIGS. 2A and 2B.

Referring to FIGS. 4 and 6, there are shown conventional antennas compared with the present invention: an open ended antenna 41 and a shorted ended antenna 61, respectively. Referring to FIG. 5, there is shown one example of the input admittance versus frequency characteristic of the open ended antenna 41 shown in FIG. 4, and referring to FIG. 7, there is shown one example of the input admittance versus frequency characteristic of the shorted ended antenna 61 shown in FIG. 6.

The open ended antenna 41 of FIG. 4 comprises a rectangular conductor (rectangular conductor pattern in the plan view) 43 and a ground conductor 44 formed on a surface S of a printed board 42, and is structured so that a power feed portion 45 is provided between one end of the rectangular conductor 43 and the ground conductor 44, and so that the rectangular conductor 43 is open at the other end.

The shorted ended antenna 61 of FIG. 6 comprises a rectangular conductor (rectangular conductor pattern in the plan view) 63 and a ground conductor 64 formed on a surface S of a printed board 62, and is structured so that a power feed portion 65 is provided between one end of the rectangular conductor 63 and the ground conductor 64, and so that a shorting portion 66 is provided between the other end of the rectangular conductor 63 and the ground conductor 64, to short both.

Generally, the characteristic impedance of an antenna system mounted on communications terminals is 50+j0 [Ω], and the characteristic admittance is 0.02+j0 [S], the reciprocal of the characteristic impedance. For this, when the antennas 1, 41, and 61 have the input admittance of 0.02+j0 [S], they are completely matched with the feed system of the antenna system, and are therefore capable of most efficient electromagnetic signal transmitting or receiving.

Figure 7:
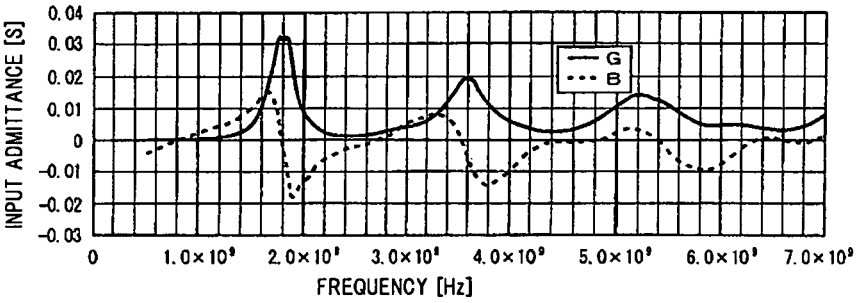
FIG. 7 is a graph showing one example of the input admittance versus frequency characteristic of the shorted ended antenna shown in FIG. 6.
Figure 8:
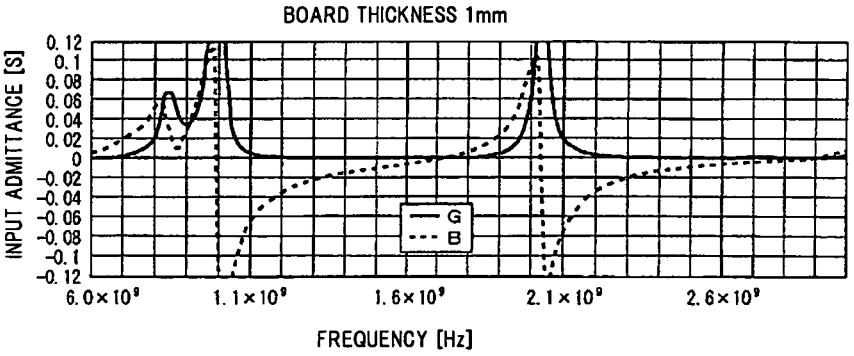
FIG. 8 is a graph showing the input admittance versus frequency characteristic of the antenna shown in FIGS. 2A and 2B when the thickness of the printed board is set at 1 mm.
Figure 9:
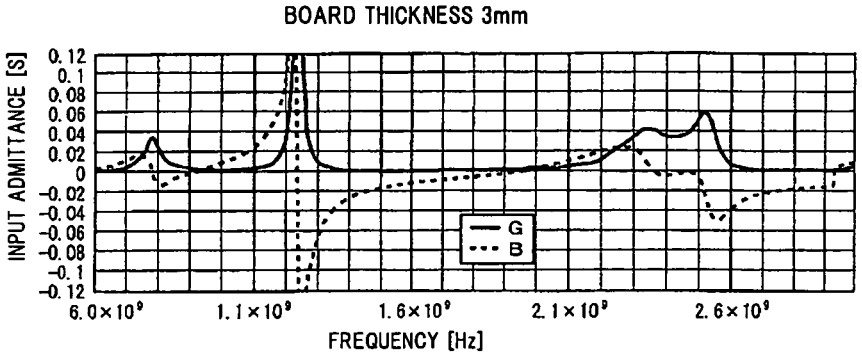
FIG. 9 is a graph showing the input admittance versus frequency characteristic of the antenna shown in FIGS. 2A and 2B when the thickness of the printed board is set at 3 mm.
Figure 10:
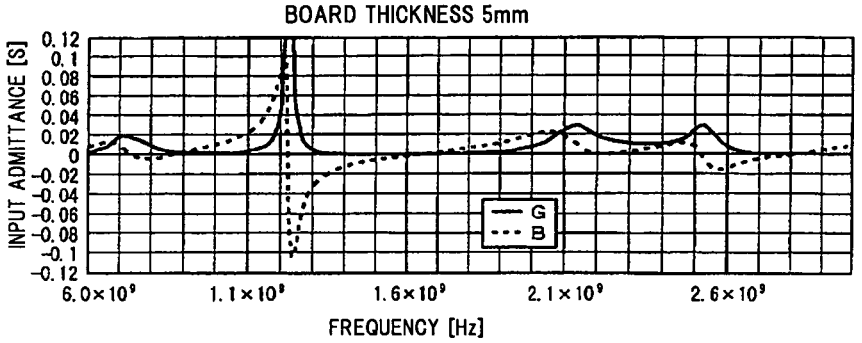
FIG. 10 is a graph showing the input admittance versus frequency characteristic of the antenna shown in FIGS. 2A and 2B when the thickness of the printed board is set at 5 mm.
Figure 11:
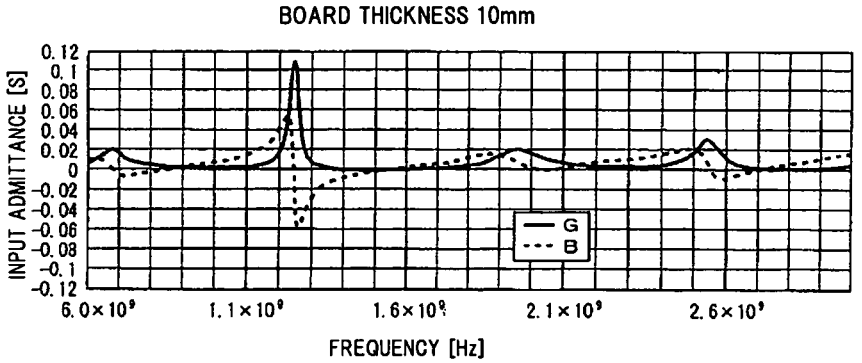
FIG. 11 is a graph showing the input admittance versus frequency characteristic of the antenna shown in FIGS. 2A and 2B when the thickness of the printed board is set at 10 mm.

As shown in FIGS. 3, 5, and 7, the antennas 1, 41, and 61 have a conductance G of 0.02 [S] around the series resonant frequency (the frequency at which the conductance G is the maximum value). In FIGS. 3, 5, and 7, although the susceptance B is not zero at the frequency at which the conductance G is 0.02 [S], adding a matching circuit allows the value of the susceptance B to approach zero, and the good matching condition with the feed system to thereby materialize. For example, the open ended antenna 41 is converted, by adding a shorting line (shorting stub) in parallel with the open ended rectangular conductor 43, into an inverted F antenna, allowing its susceptance B to be adjusted to zero, and the good matching condition with the feed system to thereby materialize.

In this manner, the antennas 1, 41, and 61 are good in the matching condition with the feed system around the series resonant frequency, more specifically around the frequency at which the conductance G is 0.02 [S].

In the open ended antenna 41 of FIG. 4, as shown in FIG. 5, the value of the series resonant frequency is, in ascending order, approximately 0.85 GHz, approximately 2.5 GHz, . Generally, in the open ended antenna, series resonant frequencies occur periodically in frequencies, so that the series resonant frequencies other than the smallest series resonant frequency are a 3n multiple of the minimum series resonant frequency where n=1, 2, 3, . . . .

Also, in the shorted ended antenna 61 of FIG. 6, as shown in FIG. 7, the value of the series resonant frequency is, in ascending order, approximately 1.8 GHz, approximately 3.55 GHz, . Generally, in the shorted ended antenna, in this manner, series resonant frequencies occur periodically in frequencies, so that the series resonant frequencies other than the smallest series resonant frequency are a 2n multiple of the minimum series resonant frequency where n=1, 2, 3, . . . .

In contrast, in the antenna 21 in the first embodiment, as shown in FIG. 3, the series resonant frequency is, in ascending order, 0.93 GHz, 1.18 GHz, , and unlike the above described open ended antenna 41 or shorted ended antenna 61, the difference between the minimum series resonant frequency and the next consecutive series resonant frequency is smaller than the minimum series resonant frequency. In other words, the antenna 21 is small in the difference between the minimum series resonant frequency (herein also referred to as "the first series resonant frequency") and the next smallest series resonant frequency (herein also referred to as "the second series resonant frequency"), in comparison with the open ended antenna 41 or the shorted ended antenna 61.

Also, from the more specific investigation of the input admittance versus frequency characteristic of FIG. 3, it is found that, in the antenna 21, the series resonant frequencies occur for the frequencies which are a 2n multiple of the second series resonant frequency. Further, although difficult to see due to the reduced scale in FIG. 3, the series resonant frequencies also occur for the frequencies which are a 3n multiple of the first series resonant frequency. That is, in the antenna 21, the antenna element 2 serves as both the shorted ended antenna element and the open ended antenna element, and consequently the difference between the first and second series resonant frequencies is considered small.

It has been known from experimental results that the operation of the antenna 21 as the open ended antenna (i.e. the first series resonant frequency) is affected by the length from the power feed portion 6 to the other end of the conductors 4 and 5, while the operation of the antenna 21 as the shorted ended antenna (i.e. the second series resonant frequency) is affected by the length from the power feed portion 6 to the through hole 24. Accordingly, the appropriate adjustment of these lengths enables the adjustment of the difference between the first and second series resonant frequencies. Incidentally, because altering the length of the conductors 4 and 5 causes a variation in the operating band, the difference between the first and second series resonant frequencies may be adjusted according to the place or position of the through hole 24.

In this manner, the antenna 21 in the first embodiment allows the two series resonant frequencies to be placed within the smaller frequency bands, to appropriately adjust the interval between those series resonant frequencies, make the two well matched frequency bands near to each other, and thereby form one broader well matched frequency band.

Reason for Setting the Distance between the Two Conductors 4 and 5 at not more than 1/100 the Wavelength Equivalent to the Minimum Frequency of the Antenna Operating Frequencies A reason for setting the distance between the two conductors 4 and 5 at not more than 1/100 the wavelength equivalent to the minimum frequency of the operating frequencies of the antenna 21 is explained next.

Using 1 mm, 3 mm, 5 mm, and 10 mm thick FR 4 glass epoxy printed boards as the printed board 22, antennas respectively having the same structure as the antenna 21 shown in FIGS. 2A and 2B are produced, and for each of the antennas, the input admittance is measured. Referring to FIGS. 8 to 11, the results measured of the input admittance versus frequency characteristic of each resultant antenna are shown.

Figure 12:
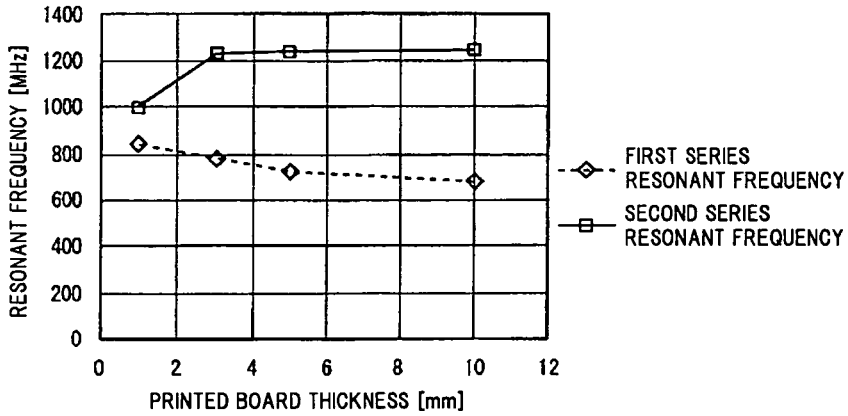
FIG. 12 is graphs showing the relationships between the board thickness and the first and second series resonant frequencies respectively of the antenna shown in FIGS. 2A and 2B.

Also, from the input admittance versus frequency characteristics of FIGS. 8 to 11 measured, for each resultant antenna, the first series resonant frequency and the second series resonant frequency are obtained, and the relationships between the board thickness and the first and second series resonant frequencies respectively are obtained. The results thereof are shown in FIG. 12.

Further, from the input admittance versus frequency characteristics of FIGS. 8 to 11, for each resultant antenna, the value of the input conductance G at the center frequency of the first and second series resonant frequencies (center frequency=(first series resonant frequency+second series resonant frequency)/2) is obtained, and the relationship between the board thickness and the input conductance G at the center frequency of the first and second series resonant frequencies is obtained. The results thereof are shown in FIG. 13.

Figure 13:
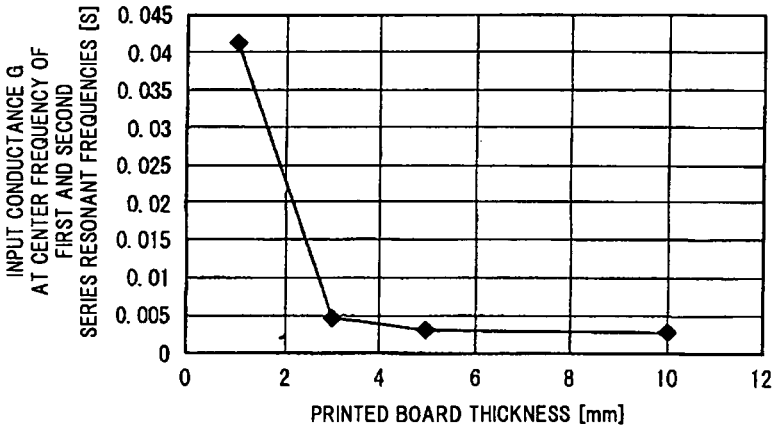
FIG. 13 is a graph showing the relationship between the board thickness and the input conductance at the center frequency of the first and second series resonant frequencies of the antenna shown in FIGS. 2A and 2B.

As shown in FIG. 13, it is found that the greater the board thickness, the smaller the input conductance G at the center frequency of the first and second series resonant frequencies, and that there is the negative correlation between the board thickness and the input conductance G at the center frequency of the first and second series resonant frequencies.

As described above, the present invention overlaps the operating band around the first series resonant frequency and the operating band around the second series resonant frequency together, and thereby realizes the broader operating band than in the conventional antenna. Accordingly, the good matching condition with the feed system is necessary to materialize at the frequencies between the first and second series resonant frequencies. Specifically, in order for the matching condition for e.g. the antenna return loss smaller than −6 dB to materialize, at least the input conductance G is necessary to be greater than $1/150 \approx 0.0067$ [S].

From FIG. 13, it is found that, in order for the input conductance G at the center frequency of the first and second series resonant frequencies to be greater than 0.0067 [S], and the good matching condition with the feed system to thereby materialize, at least the board thickness is necessary to be smaller than 3 mm.

From FIG. 12, in the antenna having a board thickness of 3 mm, the first series resonant frequency that is the smallest series resonant frequency is 790 MHz. The antenna according to the present invention is good in the matching condition with the feed system around the first series resonant frequency, and therefore operates even at the frequencies smaller than the first series resonant frequency to serve as the antenna. That is, the minimum frequency of the antenna operating frequencies is smaller than 790 MHz (=a wavelength of approximately 0.38 m). The wavelength equivalent to the minimum frequency of the antenna operating frequencies is therefore greater than at least 0.38 m.

The above results are summarized: In the antenna 21 shown in FIGS. 2A and 2B, in order to overlap the operating bands around the first and second series resonant frequencies together and thereby realize the broad band antenna, the thickness of the printed board 22, i.e. the distance between the conductors 4 and 5 is at least necessary to be smaller than 3 mm. Also, the wavelength equivalent to the minimum frequency of the antenna operating frequencies is then greater than at least 0.38 m.

Because the wavelength equivalent to the minimum frequency of the antenna operating frequencies is greater than 0.38 m, and in order to realize the broad band antenna, the distance between the two conductors 4 and 5 is necessary to be smaller than 3 mm, the distance between the conductors 4 and 5 is necessary to be not more than 1/100 the wavelength equivalent to the minimum frequency of the antenna operating frequencies.

Modifications to the First Embodiment

Modifications to the first embodiment are described next.

Figure 14A:
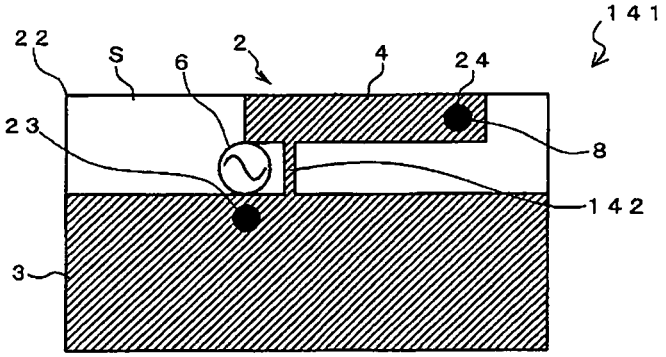
FIG. 14A is a plan view showing an antenna in one modification to the first embodiment according to the invention, when viewed from a surface side of a printed board.
Figure 14B:
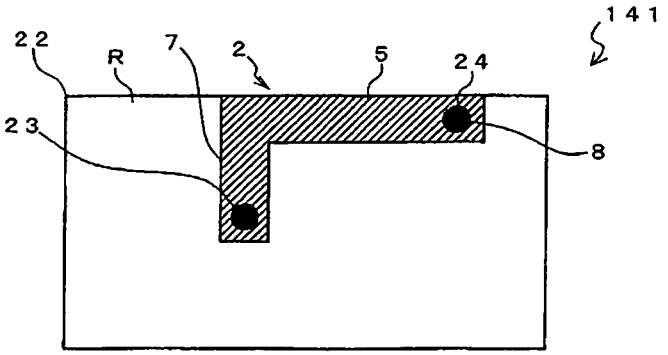
FIG. 14B is a plan view showing the antenna of FIG. 14A, when the reverse side of the printed board is seen through from the surface side thereof.

Referring to FIGS. 14A and 14B, there is shown an antenna 141 provided with a shorting line (shorting stub) 142 for matching adjustment, between the one conductor 4 and the ground conductor 3 in the antenna 21 shown in FIGS. 2A and 2B. The shorting line 142 comprises a linear conductor pattern, and is electrically connected to the one conductor 4 at one end, and to the ground conductor 3 at the other end.

The shorting line 142 is for adjusting the input susceptance B of the input admittance, to ensure improved matching, and is connected in parallel to the power feed portion 6. Thus, the shorting line 142 may, dependent on matching conditions, be omitted, as in the antenna 21 shown in FIGS. 2A and 2B. Also, the shorting line 142 may, dependent on matching conditions, be replaced with an open line (open stub).

Figure 15A:
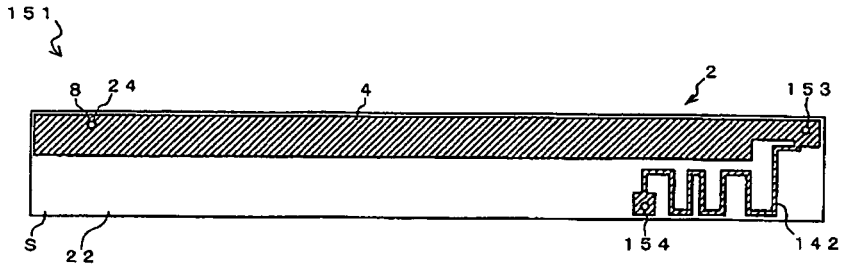
FIG. 15A is a plan view showing an antenna in one modification to the first embodiment according to the invention, when viewed from a surface side of a printed board.
Figure 15B:
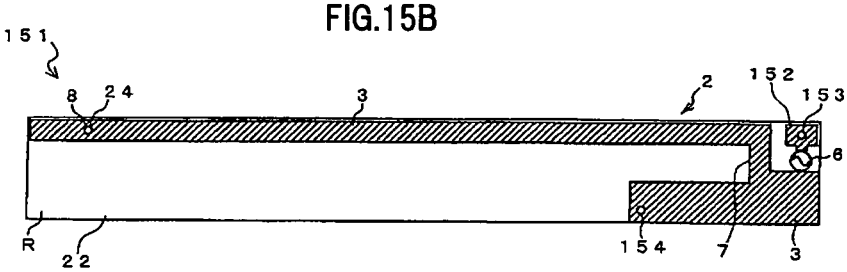
FIG. 15B is a plan view showing the antenna of FIG. 15A, when the reverse side of the printed board is seen through from the surface side thereof.

Referring to FIGS. 15A and 15B, there is shown an antenna 151 which is basically the same as the antenna 141 shown in FIGS. 14A and 14B, though slightly different therefrom in the layout of each conductor pattern.

The antenna 151 is formed with the ground conductor 3 on the reverse R side of the printed board 22, and a power feed pattern 152 is formed to be spaced apart from the ground conductor 3, and the power feed portion 6 is provided between the ground conductor 3 and the power feed pattern 152. The power feed pattern 152 is electrically connected via a through hole 153 to the one conductor 4 formed on the surface S side of the printed board 22. Also, since the antenna 151 is formed with the ground conductor 3 on the reverse R side of the printed board 22, the shorting line 142 and the ground conductor 3 are electrically connected together via a through hole 154.

Figure 16A:
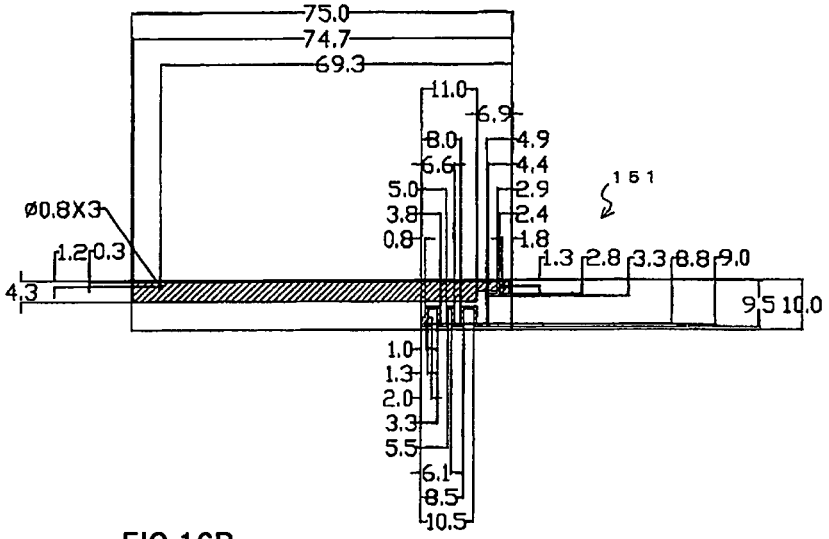
FIG. 16A is a diagram showing one example of dimensions of the antenna shown in FIGS. 15A and 15B.
Figure 16B:
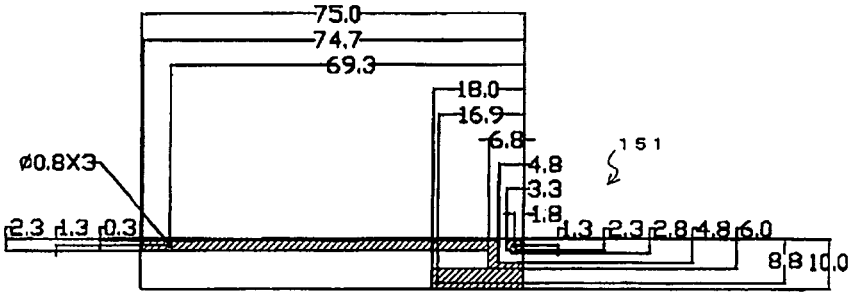
FIG. 16B is a diagram showing one example of dimensions of the antenna shown in FIGS. 15A and 15B.

Using a glass epoxy printed board having 36 μm thick copper foils (conductor patterns) formed on both its sides respectively and being 1 mm in total thickness as the printed board 22, the antenna 151 shown in FIGS. 15A and 15B is produced, and its return loss, input admittance, and radiation efficiency are measured. The dimensions of the resultant antenna 151 are shown in FIGS. 16A and 16B.

Figure 17:
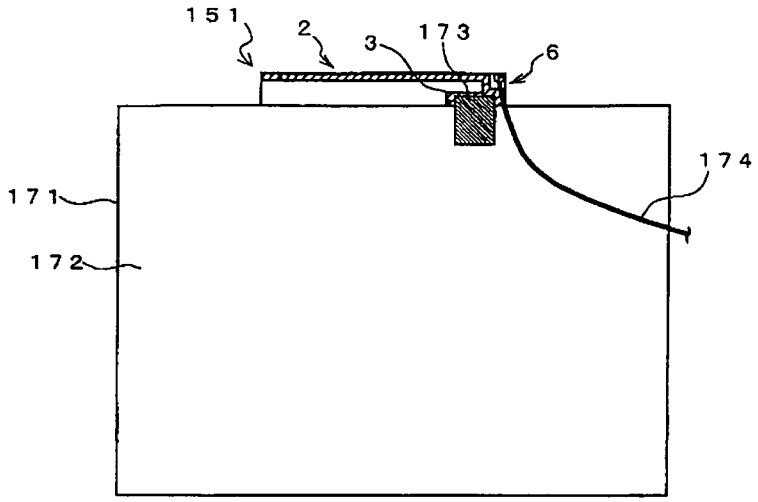
FIG. 17 is a plan view showing the antenna shown in FIGS. 15A and 15B when mounted on a glass epoxy printed board which simulates a board of a wireless device.
Figure 18:
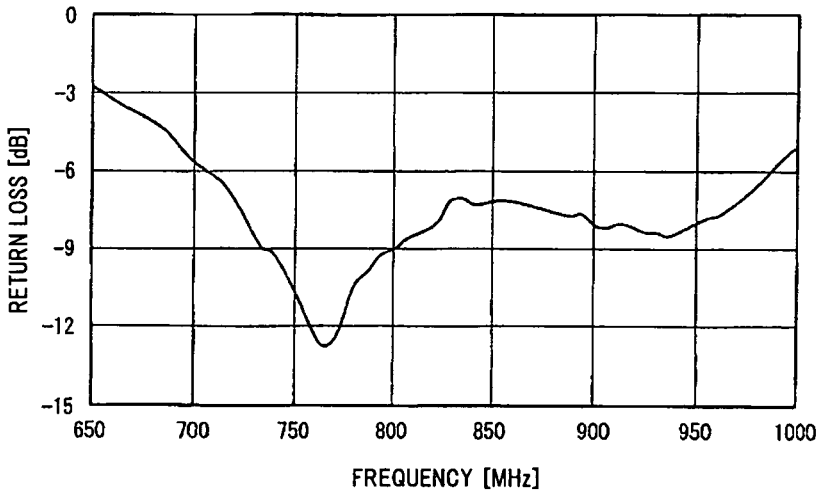
FIG. 18 is a graph showing the return loss versus frequency characteristic of the antenna shown in FIGS. 15A and 15B.
Figure 19:
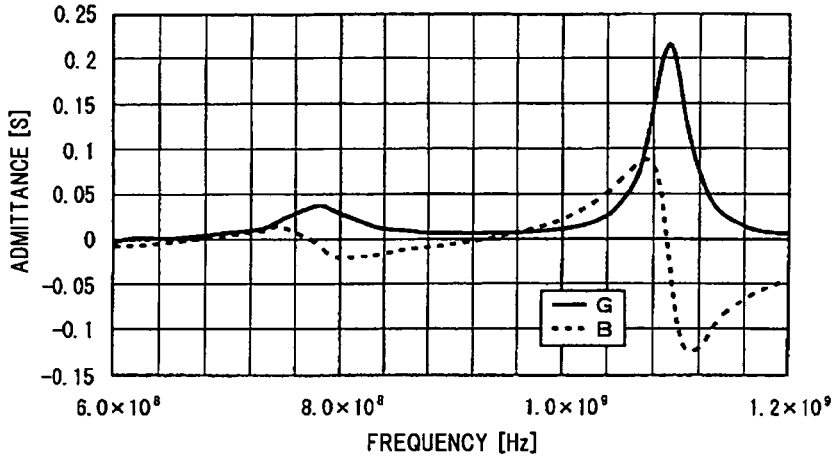
FIG. 19 is a graph showing the input admittance versus frequency characteristic of the antenna shown in FIGS. 15A and 15B.
Figure 20:
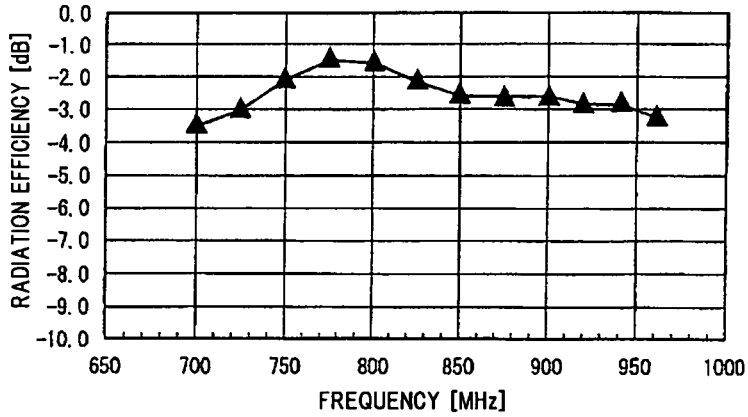
FIG. 20 is a graph showing the radiation efficiency versus frequency characteristic of the antenna shown in FIGS. 15A and 15B.

The return loss, the input admittance, and the radiation efficiency are measured by, as shown in FIG. 17, preparing a glass epoxy printed board 171 having a 36 μm thick copper foil 172 on one side and being 1 mm in total thickness which simulates a board of a wireless device to be mounted with the antenna 151, electrically connecting the copper foil 172 of the glass epoxy printed board 171 and the ground conductor 3 of the antenna 151 by means of a copper foil tape 173, and feeding the power feed portion 6 by means of a coaxial cable 174. The glass epoxy printed board 171 is 225 mm×205 mm in dimensions, and the resultant antenna 151 is disposed at the center of one side of 205 mm. Referring to FIG. 18, the results measured of the return loss are shown. Referring to FIG. 19, the results measured of the input admittance are shown. Referring to FIG. 20, the results measured of the radiation efficiency are shown.

As shown in FIG. 18, it is found that the bandwidth of the resultant antenna 151 in which the return loss is smaller than −6 dB is approximately 270 MHz (710 to 980 MHz), and that the resultant antenna 151 is well matched to the feed system in this band.

Also, as shown in FIG. 19, it is found that, in the frequency band smaller than 2 times the series resonant frequency that is the lowest frequency (i.e. the first series resonant frequency), the resultant antenna 151 has another series resonant frequency (i.e. the second series resonant frequency), which is the feature of the antenna according to the invention.

Further, from FIG. 20, it is found that the radiation efficiency is greater than −4 dB at the frequencies of from 700 to 960 MHz, and that the resultant antenna 151 operates in this frequency band to serve as the antenna. Also, the operating band of the resultant antenna 151 is approximately 32 percent in terms of fractional bandwidth. From this, it is found that the resultant antenna 151 can realize the very broad operating band for small size antennas.

Operation and Advantages of the First Embodiment

Operation and advantages of the first embodiment are described next.

In the antennas 21, 141, and 151 in the first embodiment, the antenna element 2 is constructed of the two conductors 4 and 5 arranged parallel to each other, the power feed portion 6 provided between one conductor 4 of the two conductors 4 and 5 and the ground conductor 3, and connected to the feed system, the shorting portion 7 for electrically connecting the other conductor 5 of the two conductors 4 and 5 and the ground conductor 3, and the conductor connecting portion 8 for electrically connecting the two conductors 4 and 5 together, wherein the distance between the two conductors 4 and 5 is not more than 1/100 the wavelength equivalent to the minimum frequency of the antenna operating frequencies.

This can realize the antenna element 2, which serves as both the shorted ended antenna element and the open ended antenna element, to overlap together the operating band around the series resonant frequency that is the smallest frequency (i.e. the first series resonant frequency) and the operating band around the second smallest series resonant frequency (i.e. the second series resonant frequency), thereby making it possible to realize the broader operating band than in the conventional antenna. That is, the invention can, if it is on the same order in size as the conventional antenna, realize the antennas 21, 141, and 151 which are broader in the operating band than the conventional antenna.

Accordingly, even when the operating band decreases by the distance between the conductors 4 and 5 and the ground conductor 3 being reduced to lower the height of the antenna, it is possible to ensure the sufficient operating band of the same order as in the conventional antenna, and thereby realize the antennas 21, 141, and 151 which are low in height, small in size, and compatible with the frequency bands equivalent to the conventional antenna frequency bands.

In this manner, the invention is small in size in comparison with the conventional antenna, and can particularly make small the height of the antenna, i.e. the distance from the upper end of the ground conductor 3 to the uppermost end of the antenna element 2 farthest from the ground conductor 3. As mentioned above, when the antenna is mounted to a wireless device, in order to maintain its good antenna characteristic, the antenna is generally placed near a chassis wall in the wireless device. Thus, the use of the antennas 21, 141, and 151 according to the invention which are low in height and small in size can lessen irregularities in the outer shape of the wireless device, and thereby realize the wireless device easier to store and smaller in size.

Second Embodiment

Figure 21A:
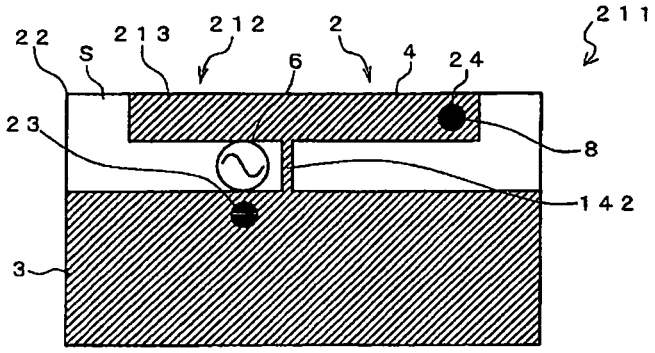
FIG. 21A is a plan view showing an antenna in a second embodiment according to the invention, when viewed from a surface side of a printed board.
Figure 21B:
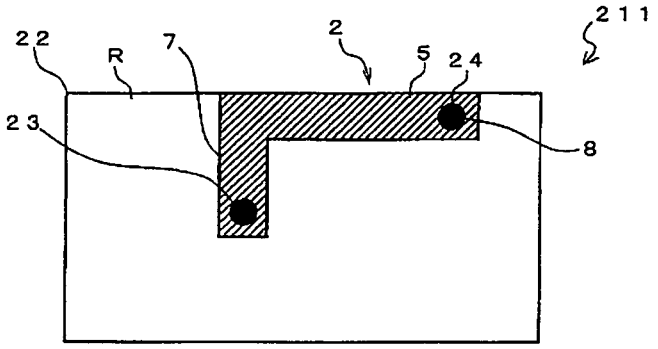
FIG. 21B is a plan view showing the antenna of FIG. 21A, when the reverse side of the printed board is seen through from the surface side thereof.

Referring to FIGS. 21A and 21B, an antenna 211 in a second embodiment according to the invention is described next.

The antenna 211 shown in FIGS. 21A and 21B is basically the same in configuration as the antenna 141 shown in FIGS. 14A and 14B, but includes a second conductor 213 for serving as a second antenna element 212 which is connected in parallel to the power feed portion 6.

The second conductor 213 comprises a rectangular conductor pattern in the plan view formed on the surface S side of the printed board 22, and it is electrically connected to a portion at one end to which the one conductor 4 and the power feed portion 6 are electrically connected, while it is open at the other end. In this antenna 211, the one conductor 4 and the second conductor 213 are formed to be joined together into one rectangular conductor pattern.

In this antenna 211, the second antenna element 212 operates as the open ended antenna. Incidentally, although herein the second conductor pattern 213 is open ended, it may be shorted ended. Also, a shorting line may be provided to electrically connect the second conductor pattern 213 and the ground conductor 3.

The antenna 211 in the second embodiment allows the second antenna element 212 to operate in a separate band from the bands of the antenna element 2 by appropriate selection of dimensions of the second conductor pattern 213, and it can thereby operate in the plural bands. The second embodiment can therefore realize the antenna 211 compatible with plural systems.

Although herein it has been described that one second conductor pattern 213 is provided, a plurality of the second conductor patterns may likewise be connected together in parallel, thereby allowing the antenna 211 to operate in many more bands. This can therefore realize the antenna 211 compatible with many more systems.

Third Embodiment

Figure 22A:
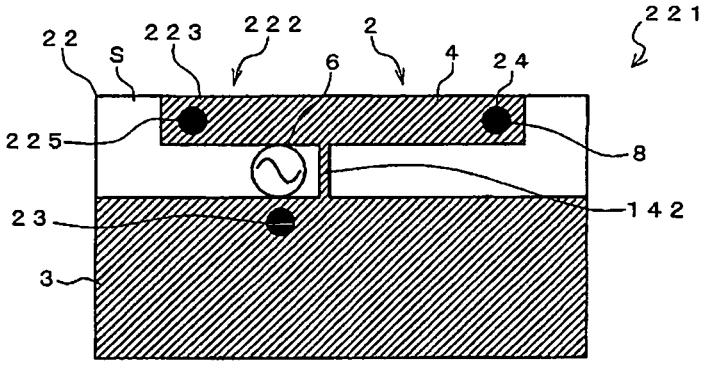
FIG. 22A is a plan view showing an antenna in a third embodiment according to the invention, when viewed from a surface side of a printed board.
Figure 22B:
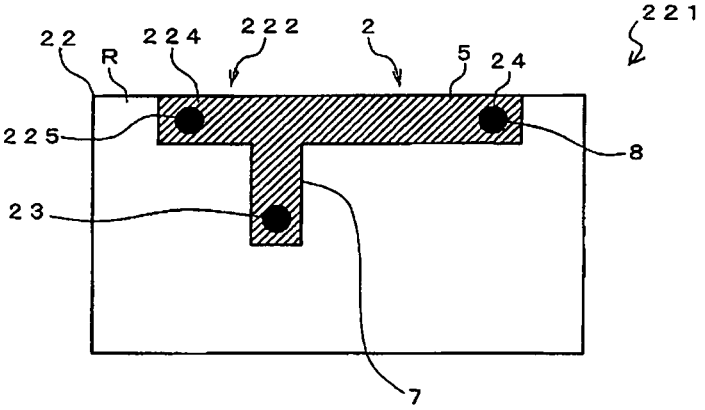
FIG. 22B is a plan view showing the antenna of FIG. 22A, when the reverse side of the printed board is seen through from the surface side thereof.
Figure 23:
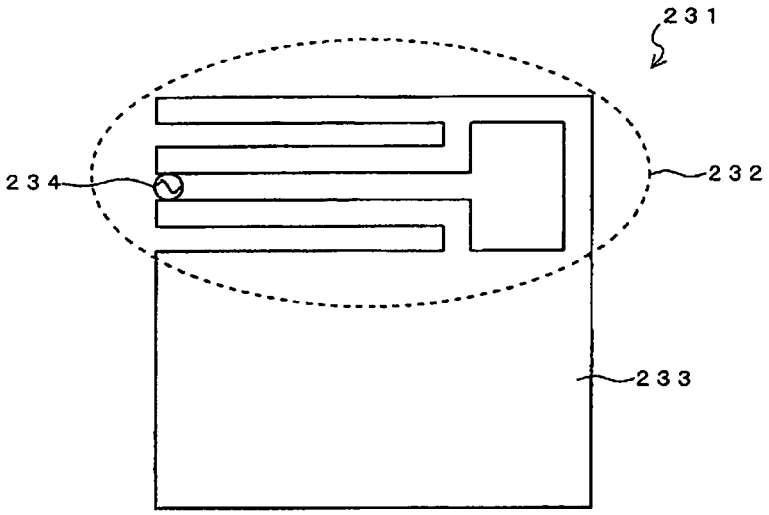
FIG. 23 is a plan view showing a conventional planar multi-antenna.

Referring to FIGS. 22A and 22B, an antenna 221 in a third embodiment according to the invention is described next.

The antenna 221 shown in FIGS. 22A and 22B is basically the same in configuration as the antenna 141 shown in FIGS. 14A and 14B, but, in addition to the antenna element 2, further includes an antenna element 222 having conductors 223 and 224 which differ in dimensions or shape from the two conductors 4 and 5 of the antenna element 2.

The antenna element 222 is provided to share the power feed portion 6 and the shorting portion 7 with the antenna element 2. In other words, the two antenna elements 2 and 222 are connected in parallel to the power feed portion 6.

The one conductor 223 of the antenna element 222 comprises a rectangular conductor pattern in the plan view formed on the surface S side of the printed board 22, and it is electrically connected to a portion at one end to which the one conductor 4 of the antenna element 2 and the power feed portion 6 are electrically connected, while it is open at the other end. In this antenna 221, the one conductor 4 of the antenna element 2 and the one conductor 223 of the antenna element 222 are formed to be joined together into one rectangular conductor pattern.

The other conductor 224 of the antenna element 222 comprises a rectangular conductor pattern in the plan view formed on the reverse R side of the printed board 22, and it is electrically connected to a portion at one end to which the other conductor 5 of the antenna element 2 and the shorting portion 7 are electrically connected, while it is open at the other end. In this antenna 221, the other conductor 5 of the antenna element 2 and the other conductor 224 of the antenna element 222 are formed to be joined together into one conductor pattern.

The one conductor 223 and the other conductor 224 of the antenna element 222 are electrically connected together via a through hole 225. The position of the through hole 225 may appropriately be set by making small the difference between the first and second series resonant frequencies of the antenna element 222, to broaden the operating band. Incidentally, as with the antenna element 2, the antenna element 222 may also be provided with a shorting line for matching adjustment, though not shown in FIGS. 22A and 22B.

In the antenna 221, the conductors 223 and 224 of the antenna element 222 are shorter than the conductors 4 and 5 of the antenna element 2, to differ therefrom in length (dimensions). This makes different the operating bands of the antenna elements 2 and 222, thereby allowing the antenna 221 to operate in the plural bands. This can therefore realize the antenna 221 compatible with plural systems.

Although herein it has been described that the two antenna elements 2 and 222 are connected in parallel, the three or more antenna elements may likewise be connected together in parallel, thereby allowing the antenna 221 to operate in many more bands. This can therefore realize the antenna 221 compatible with many more systems.

The invention should not be limited to the above embodiments, but various alterations may, of course, be made without departing from the spirit and scope of the invention.

For example, although in the above embodiments each conductor has been configured as the conductor pattern formed on the surface and the reverse of the printed board 22, each conductor is not limited thereto, but may be configured using a conductor plate such as a copper plate. In this case, the two conductors 4 and 5 of the antenna element 2 may be configured as two parallel arranged conductor plates, and the conductor connecting portion 8 may be configured as a linear conductor for electrically connecting the conductor plates together.

Also, although in the above embodiments the two conductors 4 and 5 of the antenna element 2 are parallel to each other, the conductors 4 and 5 is not strictly required to be parallel to each other, but the conductors 4 and 5 even if having a slight deviation may, of course, be embodied in the invention.

What is claimed is:

1. An antenna, comprising:

an antenna element to transmit or receive electromagnetic signals; and a ground conductor, wherein the antenna element comprises two conductors arranged substantially parallel to each other, a power feed portion provided between one conductor of the two conductors and the ground conductor, and connected to a feed system, a shorting portion for electrically connecting an other conductor of the two conductors and the ground conductor, and a conductor connecting portion for electrically connecting the two conductors together, wherein a distance between the two conductors is not more than 1/100 a wavelength equivalent to a minimum frequency of operating frequencies of the antenna, and wherein the other conductor comprises a conductor pattern formed on a surface of a printed board.

2. The antenna according to claim 1, wherein the one conductor comprises a conductor pattern formed on another surface of the printed board, and wherein the conductor connecting portion comprises a conductor formed in an inner portion of a through hole formed in the printed board.

3. The antenna according to claim 2, wherein the two conductors have widths different from each other.

4. The antenna according to claim 2, wherein the two conductors are parallel with each other.

5. The antenna according to claim 1, wherein each of the two conductors comprises a conductor plate, and wherein the conductor connecting portion comprises a linear conductor for electrically connecting the conductor plates together.

6. The antenna according to claim 1, further comprising:

a second conductor for serving as a second antenna element which is connected in parallel to the power feed portion.

7. The antenna according to claim 1, further comprising:

a plurality of the antenna elements, which share the power feed portion, and which differ in dimensions or shape of the two conductors.

8. The antenna according to claim 1, further comprising:

a coaxial cable for feeding the power feed portion.

9. The antenna according to claim 1, wherein in a frequency band smaller than two times a series resonant frequency that is a lowest frequency, the antenna has another series resonant frequency.

10. The antenna according to claim 1, wherein the two conductors have widths different from each other.

11. The antenna according to claim 1, wherein the feed system comprises a power supply.

12. A wireless device for transmitting information using electromagnetic signals, the wireless device comprising:

an antenna comprising an antenna element to transmit or receive electromagnetic signals; and a ground conductor to be grounded, wherein the antenna element comprises two conductors arranged substantially parallel to each other, a power feed portion provided between one conductor of the two conductors and the ground conductor, and connected to a feed system, a shorting portion for electrically connecting an other conductor of the two conductors and the ground conductor, and a conductor connecting portion for electrically connecting the two conductors together, wherein a distance between the two conductors is not more than 1/100 a wavelength equivalent to a minimum frequency of operating frequencies of the antenna, and wherein the other conductor comprises a conductor pattern formed on a surface of a printed board.

13. The wireless device according to claim 12, wherein the one conductor comprises a conductor pattern formed on another surface of the printed board, and wherein the conductor connecting portion comprises a conductor formed in an inner portion of a through hole formed in the printed board.

14. The wireless device according to claim 12, wherein each of the two conductors comprises a conductor plate, and wherein the conductor connecting portion comprises a linear conductor for electrically connecting the conductor plates together.

15. The wireless device according to claim 12, further comprising:

a second conductor for serving as a second antenna element which is connected in parallel to the power feed portion.

16. The wireless device according to claim 12, further comprising:

a plurality of the antenna elements, which share the power feed portion, and which differ in dimensions or shape of the two conductors.

17. The wireless device according to claim 12, further comprising:

a coaxial cable for feeding the power feed portion.

18. The wireless device according to claim 12, wherein the two conductors have widths different from each other.

19. The wireless device according to claim 12, wherein in a frequency band smaller than two times a series resonant frequency that is a lowest frequency, the antenna has another series resonant frequency.

20. The wireless device according to claim 12, wherein the feed system comprises a power supply.

* * * * *